US006674231B2

(12) United States Patent
Eta

(10) Patent No.: US 6,674,231 B2
(45) Date of Patent: Jan. 6, 2004

(54) PANEL FOR COLOR CATHODE RAY TUBE WITH SEAL AND SURFACE HAVING ROUGH SURFACE

(75) Inventor: Michiharu Eta, Otsu (JP)

(73) Assignee: Nippon Electric Glass Co., Ltd., Shiga-Ken (JP)

( * ) Notice: Subject to any disclaimer, the term of this patent is extended or adjusted under 35 U.S.C. 154(b) by 0 days.

(21) Appl. No.: 10/134,276

(22) Filed: Apr. 25, 2002

(65) Prior Publication Data

US 2003/0001486 A1 Jan. 2, 2003

(30) Foreign Application Priority Data

Apr. 25, 2001 (JP) ..... 2001-126909

(51) Int. Cl.[7] ..... H01J 31/00

(52) U.S. Cl. ..... 313/477 R; 313/480; 313/479; 348/796; 348/805

(58) Field of Search ..... 313/477 R, 480, 313/479; 348/796, 805

(56) References Cited

U.S. PATENT DOCUMENTS 5,556,018 A * 9/1996 Kanehira ..... 225/2
6,169,588 B1 1/2001 Wakatsuki et al. ..... 348/833

FOREIGN PATENT DOCUMENTS

JP 01-048536 2/1992

* cited by examiner

*Primary Examiner*—Vip Patel
*Assistant Examiner*—Kevin Quarterman
(74) *Attorney, Agent, or Firm*—J.C. Patents

(57) ABSTRACT

A panel for a color cathode ray tube includes an opening portion provided with a seal end surface to which a funnel is sealed through a frit glass. The seal end surface of the opening portion is a rough surface comprising a large number of streak-shape ridges and troughs in which minute recesses and protrusions range in a circumference direction of the seal end surface.

4 Claims, 3 Drawing Sheets

FIG. 3(b) (COMPARATIVE ART)

PANEL FOR COLOR CATHODE RAY TUBE WITH SEAL AND SURFACE HAVING ROUGH SURFACE

CROSS-REFERENCE TO RELATED APPLICATION

This application claims the priority benefit of Japan application serial no. 2001-126909, filed Apr. 25, 2001.

BACKGROUND OF THE INVENTION

The present invention relates to a panel used for a color cathode ray tube

Glass parts for a color cathode ray tube as shown in FIG. 4, includes a panel 1 on which an image is displayed, and a funnel 3 in an approximately funnel shape comprising a neck portion 2 for inserting an electron gun.

The panel 1 and the funnel 3 are sealed to each other through a frit glass 5 interposed between respective seal end surfaces 4 of the panel 1 and the funnel 3 opposing to each other The sealing is conducted as follows The funnel 3 is held while the seal end surface 4 thereof is facing up The crystalline frit glass in a slurry state mixed with an organic binder (so-called vehicle) is applied on the seal end surface 4. After the frit glass is dried, the panel 1 is placed on the funnel 3 while the seal end surface 4 thereof is facing down. The frit glass is then heated and sintered.

A fluorescence screen and a shadow mask required for displaying an image are applied on an inner surface of the panel for a color cathode ray tube. Because the panel and the funnel are sealed to each other after the fluorescence screen and the shadow mask are applied on the inner surface of the panel, flaws tend to be generated, and organic matters, carbon powders, and iron powders tend to attach on the seal end surface of the panel in a manufacturing process and transporting and packaging in the manufacturing process. If the panel and the funnel are sealed to each other while flaws or dirt are present on the seal end surfaces thereof, the sealed portion cannot have a desired strength As a result, the cathode ray tube does not present a desired strength or performance.

Namely, when the panel is transported in the manufacturing process while the seal end surface thereof is facing down, flaws tend to be generated as a result of a contact and a friction between the seal end surface thereof and a transport device. Especially, when a so-called penetration flaw, which is present across the seal end surface in the widthwise direction, is generated, and the frit glass does not completely penetrate into the penetration flaws in the process for sealing the panel and the funnel to each other, a vacuum leak occurs at the penetration flaws in the cathode ray tube When dirt is attached to the seal end surface, the dirt remains in the sealed portion as a conductive foreign material, and causes a dielectric breakdown in a following process for manufacturing the cathode ray tube. The organic matter is carbonized, and the metal component is unchanged or oxidized when they are exposed to a high temperature atmosphere at more than 400° C. in the process for sealing the panel and the funnel to each other or in an evacuation process for the glass bulb As a result, both of them remain as conductive foreign materials When a high voltage is impressed on a cathode ray tube using such glass bulb as sealed in this state, an electric field concentration may occur at the sealed portion, and may cause a breakage of the cathode ray tube.

In view of the foregoing, it is necessary to handle the seal end surface of the conventional panel with a special care.

It is preferable to mirror-finish the seal end surface of the panel in terms of preventing dirt from attaching. On the other hand, the seal end surface tends to be flawed, and to generate a penetration flaw described before. In addition, when the seal end surface is mirror-finished, there are defects such as decreased releasability of the panel from the mold after press-molding, increased possibility of seizure of glass to the mold surface, and increased time and cost of manufacturing processes such as grinding and polishing after molding.

For example, Japanese Patent Laid-Open Publication No Hei 11-40081 proposes a rough seal end surface of a panel as a measure for removing dirt and preventing flaws on the seal end surface of the panel However, since recesses and protrusions constituting the rough surface still tend to catch dirt on the seal end surface of the panel, and a large number of recesses and protrusions are randomly formed, when dirt once attached to the seal end surface has to be removed, it is difficult to sufficiently remove the dirt penetrated into the recesses Thus, the problem that the dirt tends to remain till later still survives.

SUMMARY OF THE INVENTION

An object of the present invention is to provide a panel for a color cathode ray tube having the following characteristics The panel has a seal end surface to which dirt hardly attaches, and from which dirt once attached is removed easily The seal end surface hardly generates a penetration flaw. The panel is able to obtain a desired seal strength using a frit glass, does not decrease manufacturing yield, and attains high productivity.

To attain the object above, the present invention provides a panel for a color cathode ray tube comprising an opening portion including a seal end surface, the seal end surface being to be sealed to a funnel through a frit glass, wherein the seal end surface of the opening portion is a rough surface comprising a large number of streak-shape ridges and troughs in which minute recesses and protrusions range in a circumference direction of the seal end surface Where the expression "minute recesses and protrusions range in a circumference direction" means that each of the ridges and each of the troughs themselves are minutely uneven in the circumference direction, respectively.

With the constitution above, because the seal end surface of the opening portion is the rough surface comprising the large number of the streak-shape ridges and the troughs in which the minute recesses and protrusions range in a circumference direction of the seal end surface, dirt hardly attaches to the seal end surface Because the ridges and the troughs are formed in the circumference direction of the seal end surface, wiping along the circumference direction of the seal end surface easily removes dirt once attached. Also, because the seal end surface is a rough surface, the area of contact thereof is small Thus, when the panel, for example, is transported while the seal end surface is facing down, flaws are hardly generated on the seal end surface. Because the large number of the streak-shape ridges exist, even if flaws are generated, the generation of the aforementioned penetration flaws in the widthwise direction of the seal end surface, which causes a vacuum leak of the cathode ray tube, is prevented.

Further, the frit glass tends to easily flow in the circumference direction of the seal end surface in a process for sealing the panel to the funnel Thus, filling of the frit glass into the respective recesses of the minute recesses and protrusions, which range in the circumference direction for constituting the ridges and the troughs, is promoted as well As a result, high seal strength is provided.

The streak-shape ridges and the streak-shape troughs may be continuous or intermittent as far as they are formed along the circumference on the seal end surface.

In the constitution above, it is preferable that the streak-shape ridges and troughs are formed on a surface occupying 20% or more of the seal end surface in a widthwise direction, 0.5 $\mu$m<Rz<5.0 $\mu$m is satisfied where Rz ($\mu$m) is ten-point height of roughness profile, that is, ten-point average roughness of the recesses and the protrusions of the ridges and the troughs in the widthwise direction of the seal end surface, and $100 \leqq Sm/Rz \leqq 500$ is satisfied where Sm ($\mu$m) is mean width of the profile elements, that is, an average interval between the recesses and the protrusions.

The depth of the recesses and protrusions of the ridges and the troughs in the widthwise direction on the seal end surface, and the interval between the recesses and the protrusions with respect to the depth of the recesses tend to affect the easiness for removing attached dirt When $Rz \geqq 5.0$ $\mu$m or Sm/Rz<100, the depth of the recesses and protrusions of the ridges and the troughs tends to become too deep, also the interval between the recesses and the protrusions with respect to the depth of the recesses, namely the interval between the ridges and the troughs, tends to become too narrow. On the other hand, when $Rz \leqq 0.5$ $\mu$m or Sm/Rz>500, the releasability of the panel from the mold after the press-molding tends to decrease, so that the seizure of the glass to the mold surface tends to occur With the constitution above, the depth of the recesses and protrusions of the ridges and the troughs in the widthwise direction of the seal end surface of the panel does not become too deep, and the interval between the recesses and the protrusions with respect to the depth of the recesses does not become too narrow. Thus, it is possible to prevent dirt from attaching the seal end surface and to remove attached dirt more easily. In addition, the releasability of the panel from the mold, and the prevention of the seizure of the glass to the surface of the mold further increase in the process for molding the glass panel.

To stably provide these effects, it is especially preferable to form the ridges and troughs on a surface occupying 20% or more of the seal end surface in the width wise direction.

When the seal end surface is left as a surface formed by press-molding in the constitution above, a generation of minute flaws caused by grinding, polishing and the like are avoided on the glass This is more preferable in terms of maintaining original strength of the glass forming the panel, and contributes to increasing the productivity as well.

There is a following easy method for forming the rough surface on the seal end surface of the panel of the present invention when the seal end surface is left as a surface formed by press-molding A grinding wheel, abrasive grains, sand paper or the like is used to apply a grinding operation along the circumference direction on a part of a mold for the panel, which molds the seal end surface of the panel, to form a large number of streak-shape ridges and troughs on the mold in which minute recesses and protrusions range. These streak-shape ridges and troughs on the mold are transferred on the seal end surface of the panel during press-molding. For example, the large number of streak-shape ridges and troughs, in which the minute recesses and protrusions range, are properly forms by sliding a jig, which is formed by implanting abrasive grains such as diamond or alundum on a metal rod or a metal plate In forming of the rough surface on the seal end surface by transferring from the mold, the state of the rough surface transferred on the glass surface is slightly more rounded and smoother than the state of the rough surface formed on the mold. As a result, removing dirt becomes easier

BRIEF DESCRIPTION OF THE DRAWINGS

In the accompanying drawings

DETAILED DESCRIPTION OF THE PREFERRED EMBODIMENTS

Embodiments of the present invention will be described with reference to the drawings.

Figure 1:
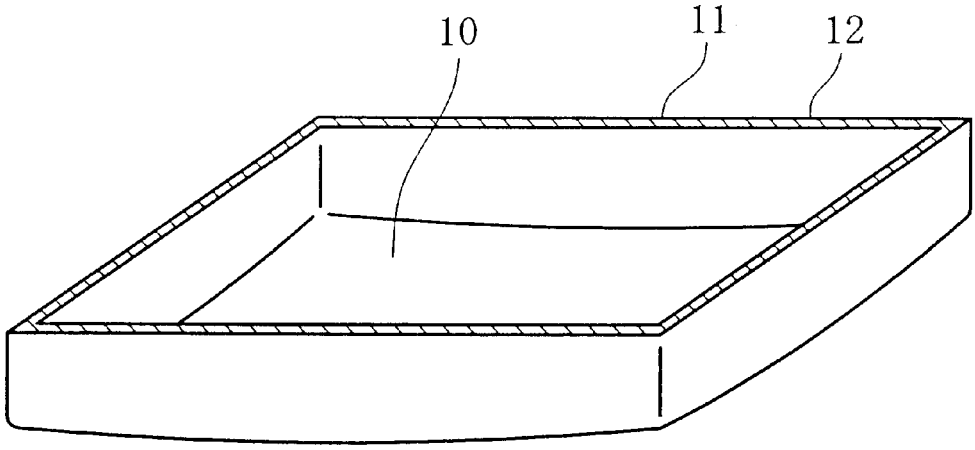
FIG. 1 is a perspective view of a panel for a color cathode ray tube according to an embodiment of the present invention.
Figure 2:
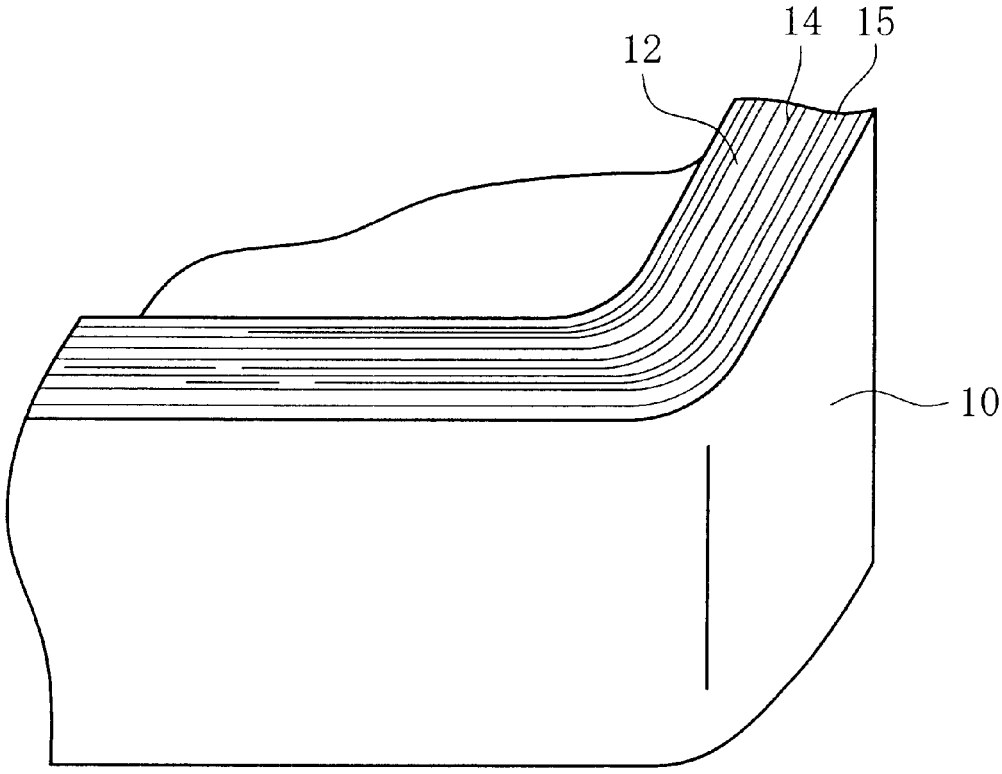
FIG. 2 is a partially enlarged schematic descriptive view showing only streak-shape ridges and troughs along the circumference direction in a seal end surface of the panel for a color cathode ray tube according to the embodiment of the present invention.

As shown in FIGS. 1 and 2, a panel 10 for a color cathode ray tube according to an embodiment includes a rough surface with a large number of streak-shape ridges 14 and troughs 15 in which minute recesses and protrusions 13 range in a circumference direction on an entire circumference of a seal end surface 12 of an opening portion 11.

Figure 3A:
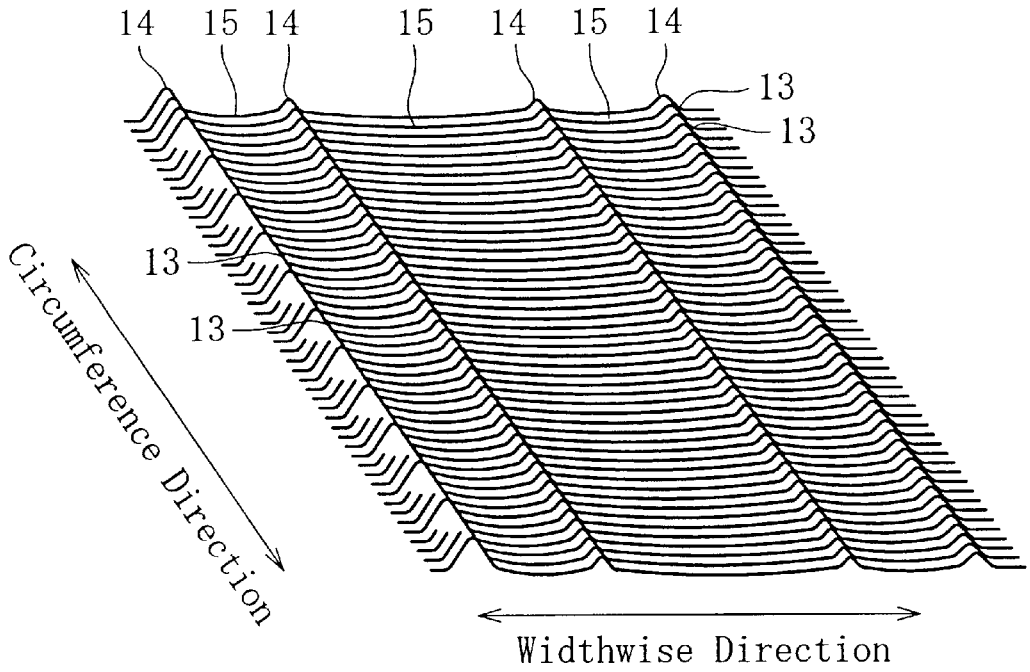
FIG. 3(*a*) is an enlarged schematic sectional view of the seal end surface in the widthwise direction of the panel for a color cathode ray tube according to the embodiment of the present invention, and FIG. 3(*b*) is an enlarged schematic sectional view of a seal end surface in the widthwise direction of a comparative art.
Figure 3A:
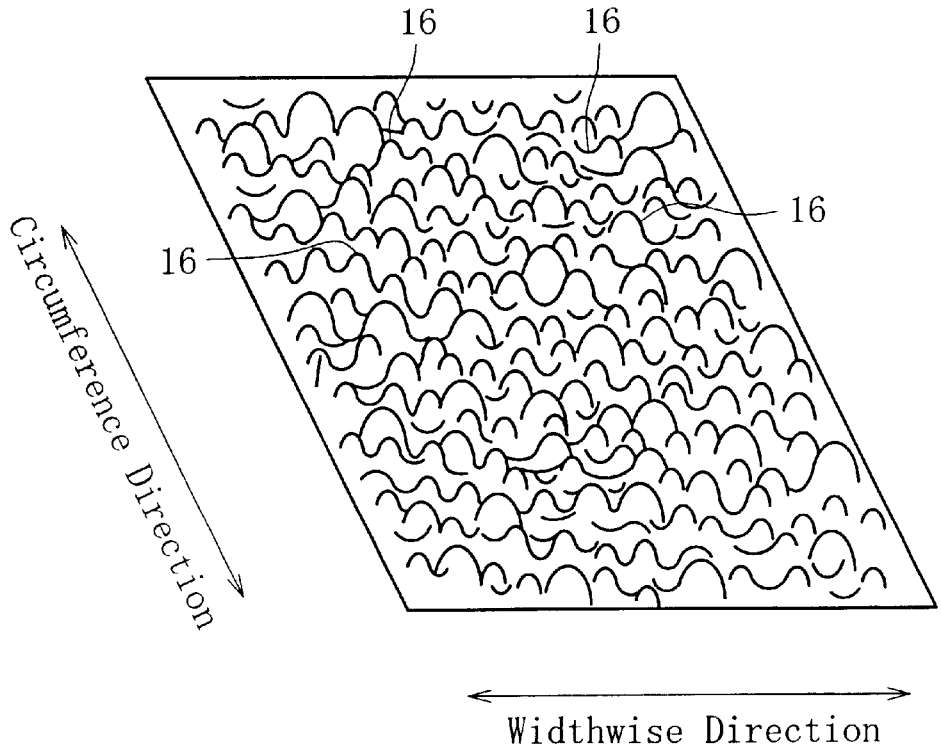
Figure 4:
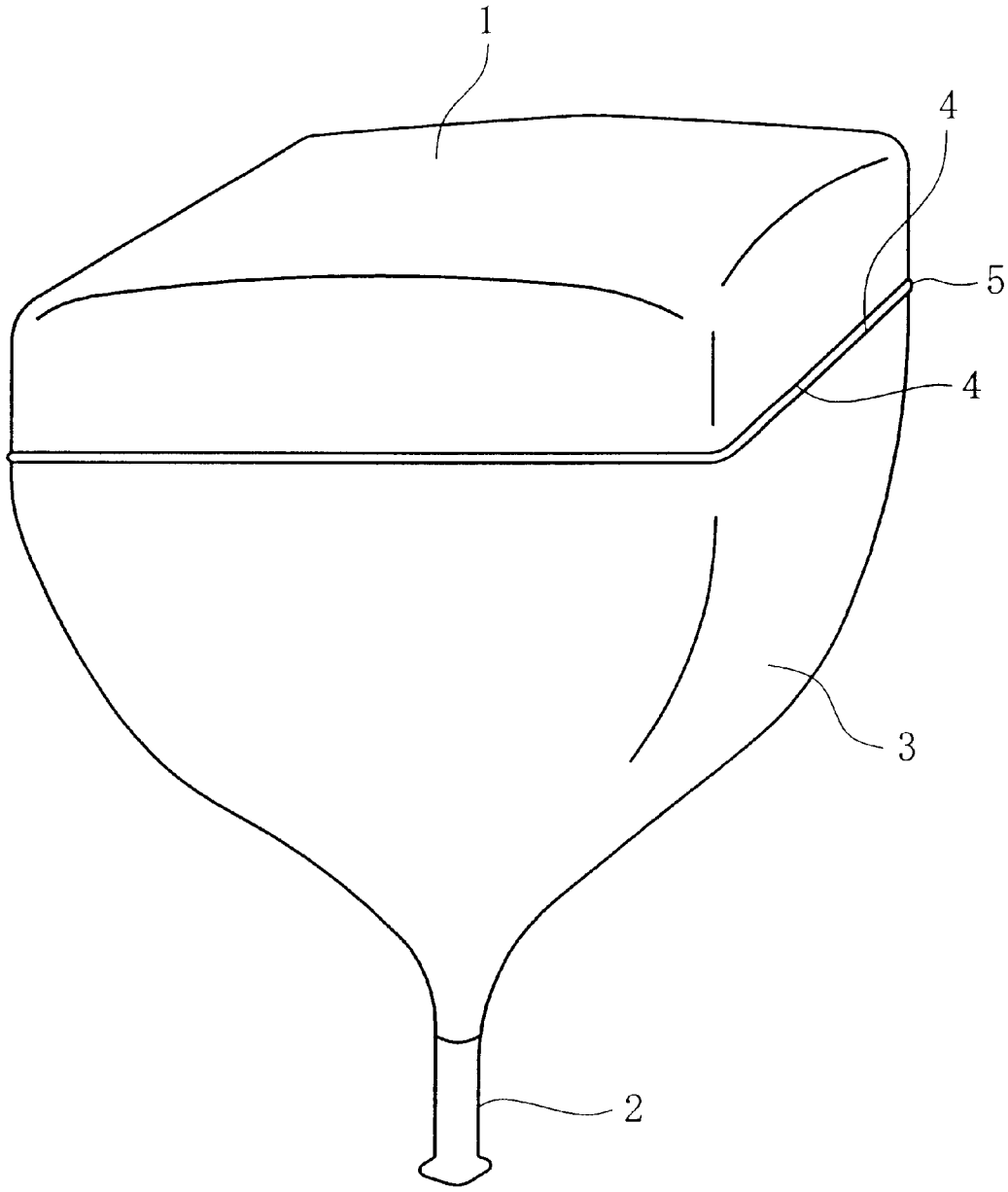
FIG. 4 is a descriptive drawing of a glass bulb for a color cathode ray tube

A comparison between a surface state of the seal end surface 12 of the panel 10 according to the embodiment, and a surface state of a seal end surface of a panel according to a comparative art presents the following result The large number of the streak-shape ridges 14 and troughs 15, in which the minute recesses and protrusions 13 range in the circumference direction of the seal end surface 12, are formed on the seal end surface 12 according to the embodiment (see FIG. 3(*a*)) On the other hand, recesses and protrusions 16 are randomly formed on the seal end surface of the comparative art (see FIG. 3(*b*)).

Table 1 shows Rz, Sm, and Sm/Rz respectively for the recesses and protrusions in the widthwise direction of the seal end surface 12 of the ridges 14 and troughs 15 formed on the seal end surface 12 of panels according to the embodiments 1 to 3, and for the recesses and protrusions randomly formed on the seal end surface of the panel of the comparative arts 1 and 2.

The panels according to the respective embodiments and the comparative arts have an approximately flat outer surface of a face The outer surface has an aspect ratio of 4:3, a diagonal outside diameter of 444 mm, a seal end surface width of 8 mm, and a curvature radius of the outer surface in the direction of the diagonal axis of 40000 mm.

The protrusions and recesses in the widthwise direction of the seal end surface of the panels according to the respective embodiments and comparative arts are measured based on the method and definition prescribed by JIS (Japanese Industrial Standards) B0601-1994 The measured values are obtained such that values for the ten-point height of roughness profile Rz and the mean width of the profile elements Sm are measured on the seal end surfaces at a minor axis (SA), a major axis (LA), and a diagonal axis (DA) of the panel, and the values are averaged for the respective axes. The surface roughness is measured for a standard length 1=0.8 mm, an evaluation length ln=4.0 mm, a vertical axis scale=2000 times, and a horizontal axis scale=50 times The values for the surface roughness on the seal end surface at the minor axis, the major axis, and the diagonal axis are obtained such that an approximately center portion in the widthwise direction of the seal end surface are measured on the respective axes.

TABLE 1

| | Rz (μm) | Sm (μm) | Sm/Rz |
|---|---|---|---|
| Embodiment 1 | 4.9 | 510 | 104 |
| Embodiment 2 | 2.0 | 250 | 125 |
| Embodiment 3 | 0.6 | 280 | 467 |
| Comparative Art 1 | 7.0 | 210 | 30 |
| Comparative Art 2 | 6.5 | 450 | 69 |

The rough surfaces on the seal end surface of the panel 10 of the embodiments 1 to 3 are formed as follows Sand paper is slid to polish a surface of a part of a mold for the panel 10 corresponding to the seal end surface of the panel 10 in the circumference direction, thereby, a rough surface comprising a large number of streak-shape ridges and troughs, in which minute recesses and protrusions range in the circumference direction, is formed on the mold. The shape of the rough surface of the mold is transferred on the seal end surface of the panel when press-molding molten glass with the mold Thus, the panel formed with the rough surface on the seal end surface is obtained. The rough surface comprises a large number of streak-shape ridges and troughs in which minute recesses and protrusions range in the circumference direction Changing the grit size of the sand paper for polishing can adjust the surface roughness of the seal end surface. In the embodiments 1 to 3, the ridges and troughs along the circumference direction are formed such that the number of the ridges and troughs is approximately 1.5/mm to 3/mm in the widthwise direction, and the length of the ridges and troughs is approximately 0.1 mm to 200 mm in the circumference direction of the seal end surface.

The rough surface is formed on the seal end surface of the panel as follows in the comparative arts 1 and 2. Blasting is applied on a surface of a part of a mold for the panel corresponding to the seal end surface of the panel, thereby, a rough surface comprising minute recesses and protrusions is formed on a mold. The shape of the rough surface comprising the random recesses and protrusions is transferred on the seal end surface of the panel. Changing the machining conditions such as blast grit, the blast speed of blast powders, and a blast time for the blasting applied on the mold can adjust the roughness of the seal end surface.

Funnels for a cathode ray tube (diagonal outside diameter: 444 mm, seal end surface width 8 mm, and deflection angle. 110°) having the same size as the panels of the respective embodiments and comparative arts were prepared The panel was held while the seal end surface was facing up, and slurry of frit glass was evenly applied on the seal end surface. The frit glass was dried. The slurry of the frit glass is obtained such that a vehicle of a mixing solution of amyl acetate and nitrocellulose, and a frit glass (ASF-1307B from Asahi Glass Co, Ltd.) are sufficiently kneaded with a weight ratio of frit glass: vehicle=12:1 for preparation.

In a conventional manufacturing process for a cathode ray tube, carbon application liquid is supplied into a hollow of the panel while the seal end surface is facing up in a process for providing a fluorescence screen The panel is then rotated to extend the application liquid on the panel Thereafter, the panel is tilted to drain the excessive application liquid from the hollow This draining especially tends to cause dirt to attach on the seal end surface To simulate the condition for the attachment and removal of dirt in the process of providing the fluorescence screen for the panels of the embodiments and comparative arts, carbon was applied with a brush on the seal end surface of the respective panels. Then the carbon was wiped off along the circumference direction of the seal end surface using gauze The seal end surface was further wiped off using gauze impregnated with acetone, and was dried Then, the panel was placed on the funnel while the seal end surface of the panel was facing down They were fixed, and subjected to a heating processing in an electric furnace at the maximum temperature of 440° C. for 30 minutes Consequently, the panel and the funnel were sealed to each other to produce a glass bulb for a cathode ray tube.

Table 2 shows the withstand voltage strength of the respective glass bulbs obtained from the procedure above.

The withstand voltage test was conducted as follows. Carbon liquid was supplied into the glass bulb to form carbon film on the entire inner surface of the glass bulb. A charge electrode was connected with an anode button mounted on a funnel wall. An earth electrode was connected with the frit seal portion. Then, a DC voltage was impressed on the charge electrode, and was gradually increased. Finally, the voltage became 70 kV, which is about twice as high as a conventional impressed voltage. In this state, the glass bulb was left untouched. After about 30 minutes, a breakage of the glass bulb was checked.

50 glass bulbs were produced for each type of the panel of the respective embodiments and comparative arts. The withstand voltage test shows the number of bulbs which generated dielectric breakdown leading to a breakage of the glass bulb as a result of dirt attached to the seal end surface.

TABLE 2

| | Number of broken bulbs |
|---|---|
| Embodiment 1 | 0/50 |
| Embodiment 2 | 0/50 |
| Embodiment 3 | 0/50 |
| Comparative Art 1 | 3/50 |
| Comparative Art 2 | 4/50 |

For the panels for a cathode ray tube according to the embodiments 1 to 3, dirt did not attach to or remain on the seal end surface. When the panel was sealed to the funnel through the frit glass, the frit glass sufficiently penetrated into the rough surface of the seal end surface of the panel. Thus, minute bubbles of remaining air were not generated in the recesses of the minute recesses and protrusions ranging in the circumference direction to form the ridges and the troughs. As a result, the frit glass presented excellent sealing. No bulb generated dielectric breakdown caused by dirt attached to the seal end surface in the withstand voltage test.

For the panels for a cathode ray tube of the comparative arts 1 and 2, dirt tended to attach to the seal end surface. It was difficult to remove the attached dirt. As a result, the sealing was conducted while the dirt remained on the seal end surface This dirt caused an electric field concentration, a dielectric breakdown occurred, and it led to a breakage of the glass bulb.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A glass panel for a color cathode ray tube, comprising:

an opening portion having a seal end surface to be sealed to a funnel through a frit glass;

wherein the seal end surface of the opening portion is a rough surface having a plurality of streak-shape ridges and troughs along a circumference direction of the seal end surface; and wherein each of the streak-shape ridges and each of the troughs is uneven in the circumference direction that a length of each of the ridges and each of the troughs is in a range of about 0.1 mm to about 200 mm in the circumference direction of the seal end surface respectively.

2. The glass panel for a color cathode ray tube according to claim 1, wherein the streak-shape ridges and troughs are formed on a surface occupying 20% or more of the seal end surface in a widthwise direction $0.5\ \mu m < Rz < 5.0\ \mu m$ is satisfied where Rz ($\mu$m) is ten-point height of roughness profile of the recesses and the protrusions of the ridges and the troughs in the widthwise direction of the seal end surface, and $100 \leqq Sm/Rz \leqq 500$ is satisfied where Sm ($\mu$m) is mean width of the profile elements.

3. The glass panel for a color cathode ray tube according to claim 1, wherein the seal end surface is left as a surface formed by press-molding.

4. The glass panel for a color cathode ray tube according to claim 2, wherein the seal end surface is left as a surface formed by press-molding.

* * * * *